US006318916B1

(12) United States Patent
Hofmann

(10) Patent No.: US 6,318,916 B1
(45) Date of Patent: Nov. 20, 2001

(54) METHOD AND CONTROL FOR CONVEYING A STRIPLIKE RECORDING MEDIUM WITH MARGINAL PERFORATION IN A PRINTER

(75) Inventor: Holger Hofmann, Munich (DE)

(73) Assignee: Océ Printing Systems GmbH, Poing (DE)

( * ) Notice: Subject to any disclaimer, the term of this patent is extended or adjusted under 35 U.S.C. 154(b) by 0 days.

(21) Appl. No.: 09/530,548

(22) PCT Filed: Nov. 10, 1998

(86) PCT No.: PCT/EP98/07170

§ 371 Date: Jun. 26, 2000

§ 102(e) Date: Jun. 26, 2000

(87) PCT Pub. No.: WO99/24262

PCT Pub. Date: May 20, 1999

(30) Foreign Application Priority Data

Nov. 10, 1997 (DE) ..... 197 49 645

(51) Int. Cl.[7] ..... B41J 13/00
(52) U.S. Cl. ..... 400/578; 400/582; 101/484
(58) Field of Search ..... 400/578, 617, 400/582; 226/31; 101/484

(56) References Cited

U.S. PATENT DOCUMENTS

| | | | | |
|---|---|---|---|---|
| 4,360,279 | | 11/1982 | Sugiura . | |
| 5,040,911 | | 8/1991 | Sanders, Jr. et al. . | |
| 5,226,742 | | 7/1993 | Pintar et al. . | |
| 5,564,845 | | 10/1996 | Yamaguchi et al. . | |
| 5,820,007 | * | 10/1998 | Crowley | 226/31 |
| 6,000,595 | * | 12/1999 | Crowley | 226/15 |
| 6,056,180 | * | 5/2000 | Crowley et al. | 226/31 |

FOREIGN PATENT DOCUMENTS

| | | |
|---|---|---|
| 40 39 389 | 6/1992 | (DE) . |
| 0 224 820 | 11/1986 | (EP) . |
| WO 95/19929 | 7/1995 | (WO) . |
| WO 97/36211 | 10/1997 | (WO) . |

* cited by examiner

*Primary Examiner*—John S. Hilten
*Assistant Examiner*—Charles H. Nolan, Jr.
(74) *Attorney, Agent, or Firm*—Schiff Hardin & Waite

(57) ABSTRACT

A method and a control for a drive which is devoid of a sprocket feed and located in an electrographic printer which outputs information on a striplike recording medium divided up into pages. It is possible to determine in a start mode whether perforated or non-perforated paper has been inserted into the printer. A recording medium with marginal perforation is initially conveyed in steps according to a control grid until it fits tightly into a larger conveyor grid which corresponds to a fraction of the distance between perforations. Subsequently, the recording medium is conveyed in normal operating mode in steps according to the conveyor grid.

18 Claims, 8 Drawing Sheets

METHOD AND CONTROL FOR CONVEYING A STRIPLIKE RECORDING MEDIUM WITH MARGINAL PERFORATION IN A PRINTER

BACKGROUND OF THE INVENTION

The invention is directed to a method and to an apparatus for the transport of a band-shaped recording medium having a marginal perforation in an electrographic printer, in particular.

Web-shaped, margin-perforated paper is mainly employed in the electrographic high-performance printer field with printing outputs of more than 40 pages per minute. The recording media are usually made of paper and have lateral holes at their longitudinal edges for transport and for monitoring the position of the paper. It is thereby driven by sprocket tractors that engage into the lateral transport holes. These recording media often also have transverse perforations along which the individual pages are separated from one another, or folds with the aid of which they can be folded together or stacked.

The feed of the perforated paper usually occurs in a specific grid corresponding to the hole spacings. Conventional paper webs have hole spacings of ½ inch. The feed can then be accomplished in accordance with 3 steps per hole spacing in a ⅙ inch grid or in accordance with 4 steps per hole spacing in a ⅛ inch grid. The paper web is then not moved continuously but step-by-step by a multiple of the grid spacing.

FIG. 1 shows this type of paper web with a margin perforation. The holes 21 in the margin region of the paper web 5 have a diameter of approx. ⅙ inch and recur at regular intervals of a=½ inch. This hole spacing a is the grid width of the hole spacings. When this kind of paper is ready-made for pages whose length can be divided by ½ inch, the fold, or respectively, the transverse perforation, that defines the beginning of a page is located precisely in the middle between two margin perforations, as represented by line 22, for example. Given page lengths that can only be divided by ⅙ inch, but not by ½ inch, the fold, or respectively, the transverse perforation, can be located on one of the grid lines 23. The fold or transverse perforation is then located in a different place relative to the perforations at the beginning of each page.

FIG. 2 illustrates essential components of printers in accordance with the prior art, which are known under the trademark Océ Pagestream®, for example. A tractor drive 24 is provided in these printers. It comprises a step motor 26, which drives a tractor wheel 25, whose spindles engage in the margin perforations 21 of the paper web 5. The step motor 26 is driven by an electronic control unit 27, which receives clock signals 30 from an image generating unit, on the one hand, and receives clock signals about the current speed of the step motor from a sensor 28, on the other hand. These signals are formed by sampling a timing disk 29 that is connected to the drive shaft of the step motor. The signals of the timing disk correspond to an advance of ⅙ inch; that is, they correspond exactly to the transport grid. The control unit 27 converts the image generation signals 30 in a fixed frequency ratio into drive signals 31 for the step motor 26, which effectuate an advance of ⅙ inch on the paper web, respectively. When the printer is turned on, the drive is initialized. For this purpose, the tractor wheel 25 is aligned to the ⅙ inch transport grid. The control unit 27 generates drive signals in steps of 1/240 inch until it receives a signal from the sensor 28 indicating that a ⅙ inch marker of the timing disk 29 has been detected at the sensor 28.

Once the drive 24 has been aligned to the transport grid, the paper web 5 can be advanced in the ⅙ inch grid such that, with each ⅙ inch step, a reference point, for instance the fold 22, advances exactly from one ⅙ inch increment marker to the next ⅙ inch increment marker on the rule 65 that is fixed to the housing. In the course of initialization, a marker of the paper web 5, for instance the transverse perforation or the fold, is thus positioned at the corresponding page marker (10", 11", 12" or 13") of the rule 65 in ⅙ inch increments. The following pages are then automatically exactly positioned on the basis of the restricted guidance by the sprocket tractor.

Margin perforation is employed particularly in the processing of preprinted paper. In this paper, the information that is to be subsequently added, for instance data that are printed into a preprinted form, should be situated optimally precisely in predetermined locations on the blank.

The perforated paper is usually fed in a defined grid corresponding to the hole spacings, for instance in a ½ inch grid or in a ⅙ inch grid. The paper web is moved incrementally by a multiple of the grid spacing.

There is frequently also the demand in the high-performance printing field to be able to employ continuous-form paper that does not comprise such margin perforations in printers for continuous-form paper. Both economic as well as ecological considerations contribute to this demand. Margin-perforated paper is more expensive than paper without margin perforations, since the margin perforations need to be punched in an additional procedure in the course of paper production. An additional processing step is likewise required when printing margin perforated paper for removing the margin strips from the printed page, whereby the waste that thereby arises must be disposed of.

For example, WO 95/19929 A1 discloses a printer that is suitable for processing continuous-form paper without margin perforation which is fed from a roll or stack.

A first seating edge, which prescribes the lateral position of the paper, as well as stabilization rollers, and under-pressure brake and a roller arrangement with a loop-drawing means are provided in this printer for the exact transport of the paper.

Roll papers both with as well as without margin perforation can be fundamentally processed with such a device via a tractorless friction drive. An advantage of this is that paper with margin perforation can still be processed, even though this perforation is not used for transport and guidance of the paper. Papers having margin perforation are frequently still kept in stock in printing centers or are delivered already preprinted. Therefore, it should still be possible to use perforated roll paper in a device which does not necessarily need the margin perforation for transport purposes.

On the other hand, tractorless friction drives have the problem that the transport precision in the feed direction cannot always be adhered to. For example, slippage between the friction roller and the recording medium can contribute thereto.

DE-A-40 39 389 teaches a tractorless drive with which a margin-perforated recording medium can be transported. The transport is controlled by means of a control mechanism, with target positions of the recording medium being computed at reference points and the actual position of the margin holes being detected using a sensor.

SUMMARY OF THE INVENTION

It is an object of the invention to set forth a method and a device for controlling a tractorless drive in a printer, with which web-shaped recording media both with and without margin perforation can be transported in the feed direction with high precision.

This object is achieved by a method for controlling a tractorless drive in an electrographic printer which prints by page on a band-shaped recording medium and wherein a margin-perforated recording medium is first transported in a start mode in increments of a control grid and is fitted in this process into a second grid forming a transport grid which is larger than the control grid, and which corresponds to a fraction of hole spacing. In a drive control target signals as image generating signals of a first frequency are received which are generated by an image generating unit or are synchronous to signals of the generating unit, actual signals of a second frequency being received by a sensor arrangement that continually scans the recording medium, and control signals of a third frequency for driving a drive motor which are formed from a comparison of the target signals and the actual signals. The drive occurs in increments of the control grid, and the speed of the drive motor is regulated. The control signals for the drive motor do not stand in a fixed frequency ratio to the image generating signals.

A margin-perforated recording medium is first transported according to the invention in a start mode using a friction drive in increments of a first, smaller grid (what is known as the control grid) until it is fitted into a second, larger grid, which is known as the transport grid, which corresponds to a fraction of the hole spacing. In the fitted state, a point that may be marked on the recording medium, for instance a line, a transverse perforation, or a fold, attains predetermined positions, for instance markings on a rule that is permanently connected to the drive, in regular numbers of steps of the transport grid.

During the transport movement, the transport perforation of the recording medium is scanned regularly, particularly without interruption, and the scan result is utilized to control the drive, particularly to compensate a slippage occurring between a friction drive roller and the recording medium. In a normal mode that follows the start phase of operation, the margin-perforated paper is transported in increments of the transport grid, with the control being maintained with the aid of the scanning of the transport perforation.

In a preferred embodiment of the invention, it is first determined whether paper with margin perforation or paper without margin perforation has been inserted in the printer before the transport process is started in the control grid. The invention can be used in an electrographic printer or copier, in particular.

Although a tractorless paper transport makes possible a stepless transport of the margin-perforated paper, the invention provides that this paper is transported both in the start mode and in the normal mode in specific grid increments, or respectively, that the drive control is designed at least partly in steps. It was recognized according to the invention that with margin-perforated paper, an incremental positioning leads to a more precise positioning overall. Owing to the incremental feed particularly in the start mode, mispositionings of the paper can be detected easily with reference to the reference marks at the printer. They can therefore be avoided more easily than given a continuous drive. A mispositioning then always leads to a deviation by at least one grid step. Such large deviations can be easily detected, by the operator or automatically, at a grid rule that is arranged in the region of the paper motion, and they can then be corrected. This check, or respectively, correction, can occur at the beginning of the print or paper insertion process already.

The incremental motion is advantageously executed using a step motor, though in principle it could also be accomplished using other motors, for instance a correspondingly controlled d.c. motor.

The invention specifically provides that, to control the drive motor, sensor signals about the speed of the recording medium are compared to reference signals, which are delivered by an exposure unit but which are at least synchronous to its clock, and that control signals are formed from these. These control signals are preferably not necessarily synchronous to the signals of the exposure unit in terms of cycles; that is, the two signals do not stand at a fixed frequency ratio to one another. As a result, the control can be tuned very finely independent of the exposure cycles of the image generating part of the printing means.

In the inventive method, the perforations of the paper web can be continuously scanned in the start mode and in the normal mode. For this purpose, a sensor arrangement is provided, which engages in the margin holes and whose signals are used by a drive control to control the paper drive. Specifically, this control compensates slippage between the paper drive and the paper web by additional feeding or by adjusting the drive speed. This guarantees that the printed image is transferred onto the paper on the correct page.

Non-perforated paper can be scanned by a marker sensor with respect to preprinted markers, and a page marker that is located on the paper can likewise be transported to a predetermined feed position. The paper without margin perforation can be transported continuously and need not be transported with the stepwidths of the transport of margin-perforated paper.

The sensor for scanning the margin perforation has a resolution that is equal to or less than the hole spacing of the recording medium. Particularly when the resolution and hole spacing are identical, the current position of the transport perforation relative to the transport means can be directly determined from the sensor signals, potentially in consideration of a calibration offset of the sensor, and a highspeed start mode can be implemented.

In an advantageous embodiment of the invention, the recording medium web is fed in transport grid increments until a page break of the recording medium is located adjacent a permanent page marker of the printer. This page marker corresponds in particular to the page length and is located on a rule that is fixed in the drive assembly.

The electronic control unit makes it possible to process roll paper that does not have perforations in the same manner as roll paper that does (i.e., to transport both incrementally), or to transport paper without margin perforation in a different manner than margin-perforated paper, for instance to drive one type of paper with completely steplessly, and to drive the other at least partly incrementally.

In a further advantageous embodiment of the invention, when a print stoppage is required, the paper web is held in such a way that a predetermined position within a printed page, in particular a page boundary, is situated adjacent to a predetermined position of the recording medium transport path. The stop positions are always oriented to the grid that is prescribed by the margin perforations. The proper position of the printed image relative to the beginning of the page then also remains subsequent to the print stop. The print process can then be continues, particularly with the page immediately following, thus minimizing the material losses (waste paper).

Exemplifying embodiments of the invention are detailed below with the aid of several Figures, from which additional aspects and advantages of the invention emerge.

DESCRIPTION OF THE PREFERRED EMBODIMENTS

Figure 1:
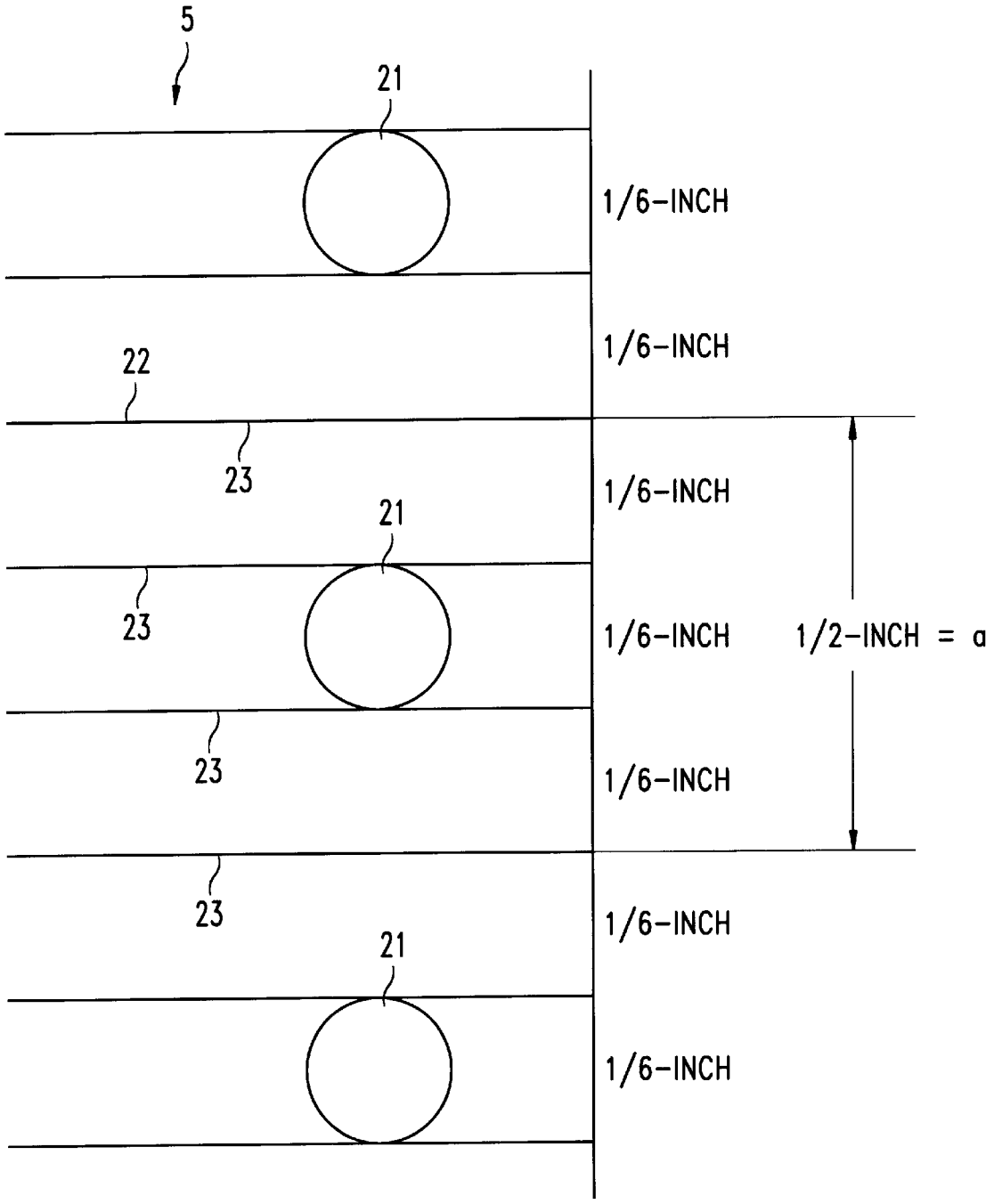
FIG.1 PRIOR ART
FIG. 1 shows margin-perforated paper in accordance with the prior art.
Figure 2:
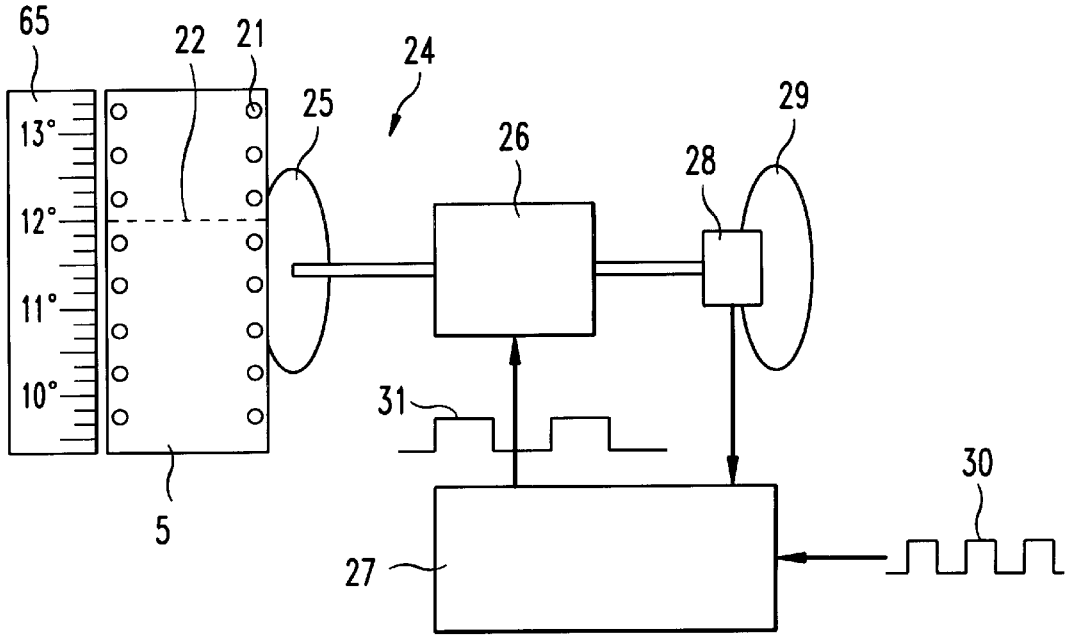
FIG.2 PRIOR ART
FIG. 2 shows components of a drive in accordance with the prior art.
Figure 3:
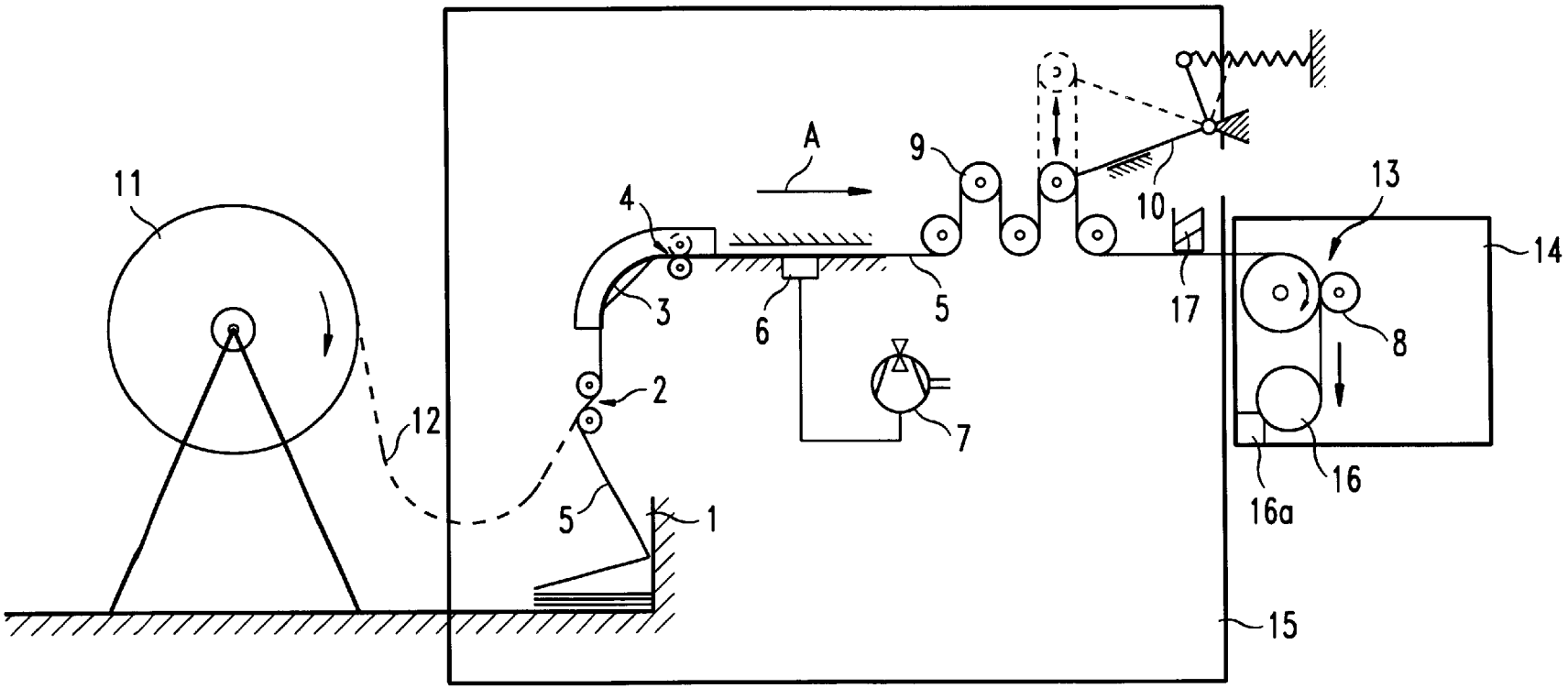
FIG. 3 shows a printer having a tractorless paper drive.

The printer device represented in FIG. 3 draws a band-shaped recording medium (paper) from a paper input receptacle 1 or from a supply roll 11. In the roll operation, the paper web 5 is fed to a guide mechanism 2 via a loop 12 and is then fed along a seating edge to friction drive rolls 4 in a web precentering device 3. Next, it is drawn by a drive 8 via a under-pressure brake 6, which is connected to a vacuum pump 7 that generates the under-pressure. The paper web 5 is braked by the under-pressure, increasing the tension of the paper web. The higher the tension is, the more stably the paper web 5 runs in transport direction A; that is, the less it slides out of the desired paper transport direction laterally. Following the under-pressure brake 6, the paper web 5 passes through a stabilizing zone, which consists of several guide rolls 9 and a loop draw 10. The paper web surrounds the guide rolls 9 at least 180°, stabilizing the paper web laterally even more.

Before the paper web 5 is fed to a print assembly, a sensor arrangement 17 scans the paper optically. The sensor arrangement 17 is laid out such that it can scan the widest paper that can be processed in the printer over its entire width. The width of the sensor arrangement is thus adapted both to the mechanism components for paper transport and to the parameters of the printing device 14 on the recording side, which determine the printable width. It is suited to the width of a photoconductive drum 16, in particular. In the present exemplifying embodiment, the processible paper width ranges from 6.5 inches (165 mm) to 19 inches (482.6 mm). Details of the sensor arrangement 17 are described in the German patent application 197 49 676.8, the contents of which are hereby incorporated into the present specification.

From the sensor arrangement 17, the paper web 5 is fed to a transfer station via a drive assembly 13. In this exemplifying embodiment, the transfer station comprises a photoconductive drum 16, which works in conjunction with a corotron device 16*a*. The photoconductive drum 16 is charged with information by light in known fashion, a charge image being thus applied. It then picks up a magnetized toner, which is transferred to the paper web 5 in the print transfer area. Next, the corotron device 16*a* discharges the corresponding area of the photoconductor drum again, so that this can be written with information again. The corotron device 16*a* operates in known fashion, as described in EP 0 224 820 B1. The latter's contents are also hereby incorporated into the present specification.

In the illustrated example, the sensor arrangement 17 is arranged in the region of the paper feed 15, though it can also be provided inside the print assembly 14. The paper web 5 is transported in the paper transport device A.

Figure 4:
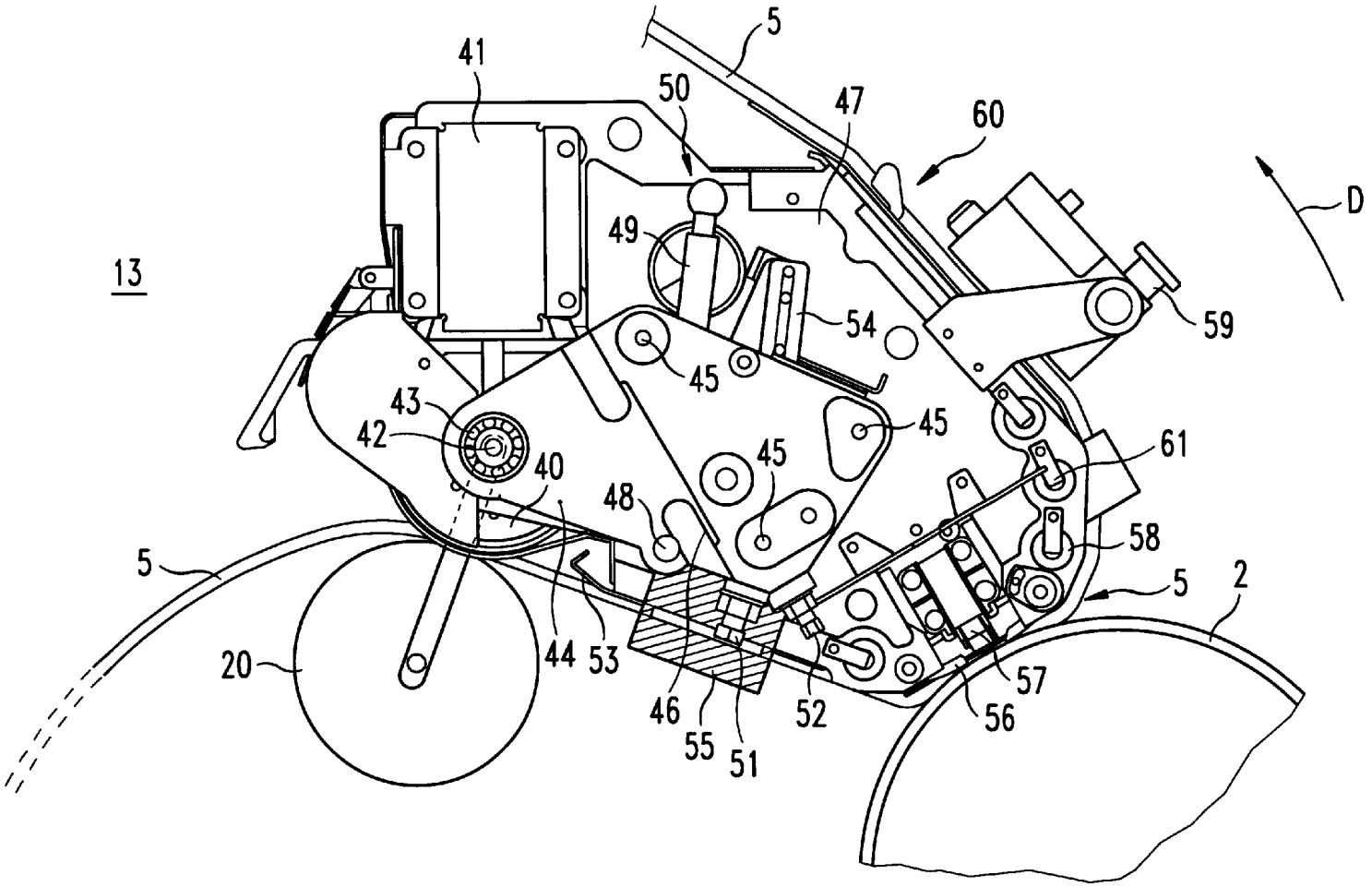
FIG. 4 is a section through a drive assembly.

FIG. 4 more closely shows the drive assembly 13 that is arranged in the region of the print transfer station, or respectively, the photoconductive drum 16 of the electrographic printer.

At the drive roller 40, a roll arrangement 20 presses with the prescribed springing force. As a result, the paper that is being transported through between the rolls 40 and 20 is moved by the drive roller 40 by means of friction. The drive roller 40 is connected to the step motor 41 via a toothed gear drive, in turn. The overall drive assembly 25 is flanged to a printer housing via the bearing block or frame 44. At the bearing block 44, a common bearing axle 42 is borne by the ball bearing 43, said axle receiving the rotational motion of the drive roller 40, on one hand, and making it possible for the drive elements to pivot about the axis B, on the other hand. To enable the pivoting motion, the drive components are mounted on a carrier plate 47, which is connected via a gas pressure spring 49 and via the bearing axle 42 to the bearing frame 44.

Threads 45 in the bearing frame 44 serve to receive fixing screws which are led through the printer housing 18. The overall drive assembly can be aligned within the printer housing via guide surfaces 46. The carrier plate 47 can be aligned in turn with respect to the bearing block or frame 44, a first adjustment screw 51 and a second adjustment screw 52, at which the straight pins at the carrier side abut, being provided in the bearing frame 44.

The gas pressure spring 49 is connected to the carrier 47 by the threaded connection 50 and to the bearing frame 44 by the threaded connection 48. Carrier 47 and bearing frame 44 can be locked against one another using the lock mechanism 54.

A paper web which is inserted into the drive assembly 25 between the drive roller 40 and the counterpressure roller 20 is led by a guide plate 53 to a paper sensor 55. The paper sensor scans the paper over the entire width of the printable area of the photoconductive drum, by which process it is possible to detect the lateral paper edges as well as potential margin perforations of the paper web. In the region of the print transfer zone 5 of the print device, the paper is pressed by the spring-loaded pivot cheeks to the surface of the photoconductive drum 2. An electric corotron device 57, which is known per se, generates a high voltage, by which the toner that is located on the photoconductive drum is drawn to the paper. Guide rollers 58 guide the paper further to a mark sensor 59, which detects print or cut markers that may be present on the paper web. Grounded electrical connections 61 (antistatic plates) dissipate electrical residual charges that may be present on the paper.

When paper with margin perforations is transported using the paper transport, the margin perforation can be scanned using a pin feed wheel 60.

Figure 5:
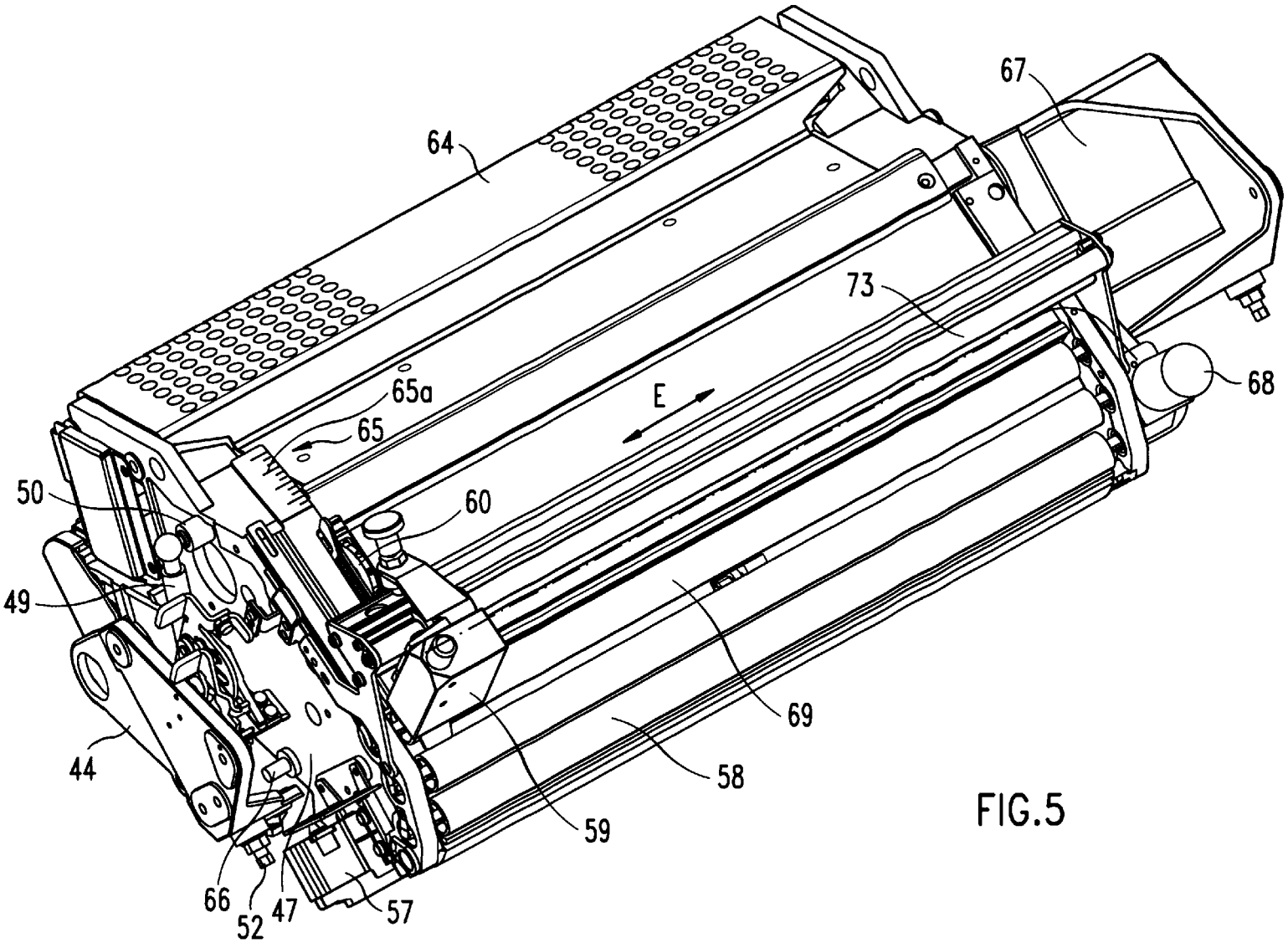
FIG. 5 shows a view of the drive assembly.

FIG. 5 shows the paper drive 25 in a three-dimensional representation. Specifically, the straight pin 66 that is installed at the carrier plate 47 can be seen, which works in conjunction with the adjustment screw 52 that is screwed into the bearing frame 44, as well as the screw connection 50 of the gas-pressure spring 49.

Above the guide rollers 58, the paper is led by a guide surface 69. In this area, the scanning of the paper with the mark sensor 59 is also accomplished. Furthermore, a seating rule 65 is provided in this area, which is used for the printer's start process. Newly inserted paper which has margin perforations is seated with the beginning of a page at a mark 65*a* on the rule 65 (which corresponds to the page length); the margin perforation is engaged with the barbed wire, which has been pivoted in thereto; and the print process is initiated. The pin feed wheel 60 is a component of a sensor arrangement which is described more closely in FIG. 6.

In the transfer area, a drive motor 68 draws a corotron wire corresponding to the printable width of the page from the corotron wire cassette 57. The mark sensor 59 can be displaced along the bar 73 in direction E. The plate 66 covers the drive motor 41 and serves in particular for electromagnetic shielding. Corresponding to the front bearing frame 44, a rear bearing frame 67 is also provided, which is likewise secured at the printer housing.

Figure 6:
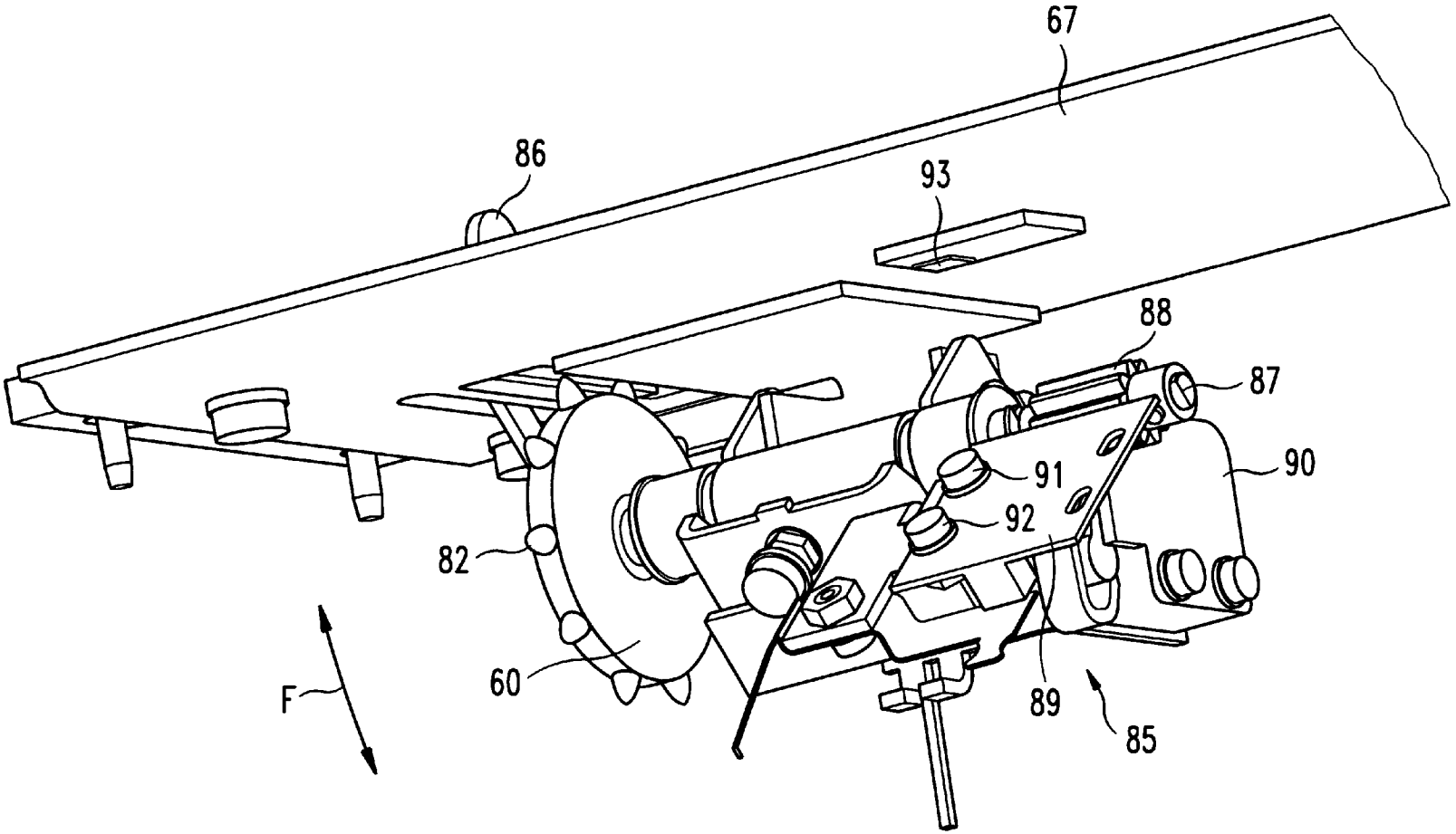
FIG. 6 shows a sensor arrangement.

FIG. 6 shows the pin feed wheel sensor 85, which comprises the pin feed wheel 60. In the position illustrated, the pin feed wheel is swivelled out; that is, the pins do not project out over the paper guide plane 67. This pin feed wheel 60 can be swivelled in and out in direction F using the actuating lever 86. The pin feed wheel 60 is mounted on an axle 87, which likewise bears a toothed gearwheel 88. A magnetoresistive sensor 91 detects impulses of the metal toothed gearwheels of the toothed gearwheel 88. These impulses can be unambiguously allocated to the rotational movement of the pin feed wheel 60, so that the scanning of the margin perforation of the paper can proceed over the paper plane 67 and can engage with the pinwhseel 60. From these impulses, the speed of the paper web and its position in relation to the transport grid of the drive mechanism can be computed. The signals of the sensor 85 are therefore used as input signals for an anti-slip control of the paper drive. The sensor assembly 89 is connected electrically to a device control (FIG. 7) for this purpose.

A second magneto-resistive sensor 92 detects whether the pin feed wheel sensor 85 is in the in or out position relative to the paper guide plane 67. For this purpose, it acts in conjunction with the magnet 93 that is mounted on the guide surface 67. Using a stop mechanism 90, the overall pin feed wheel sensor 85 can be held in the in or out position, respectively.

Figure 7:
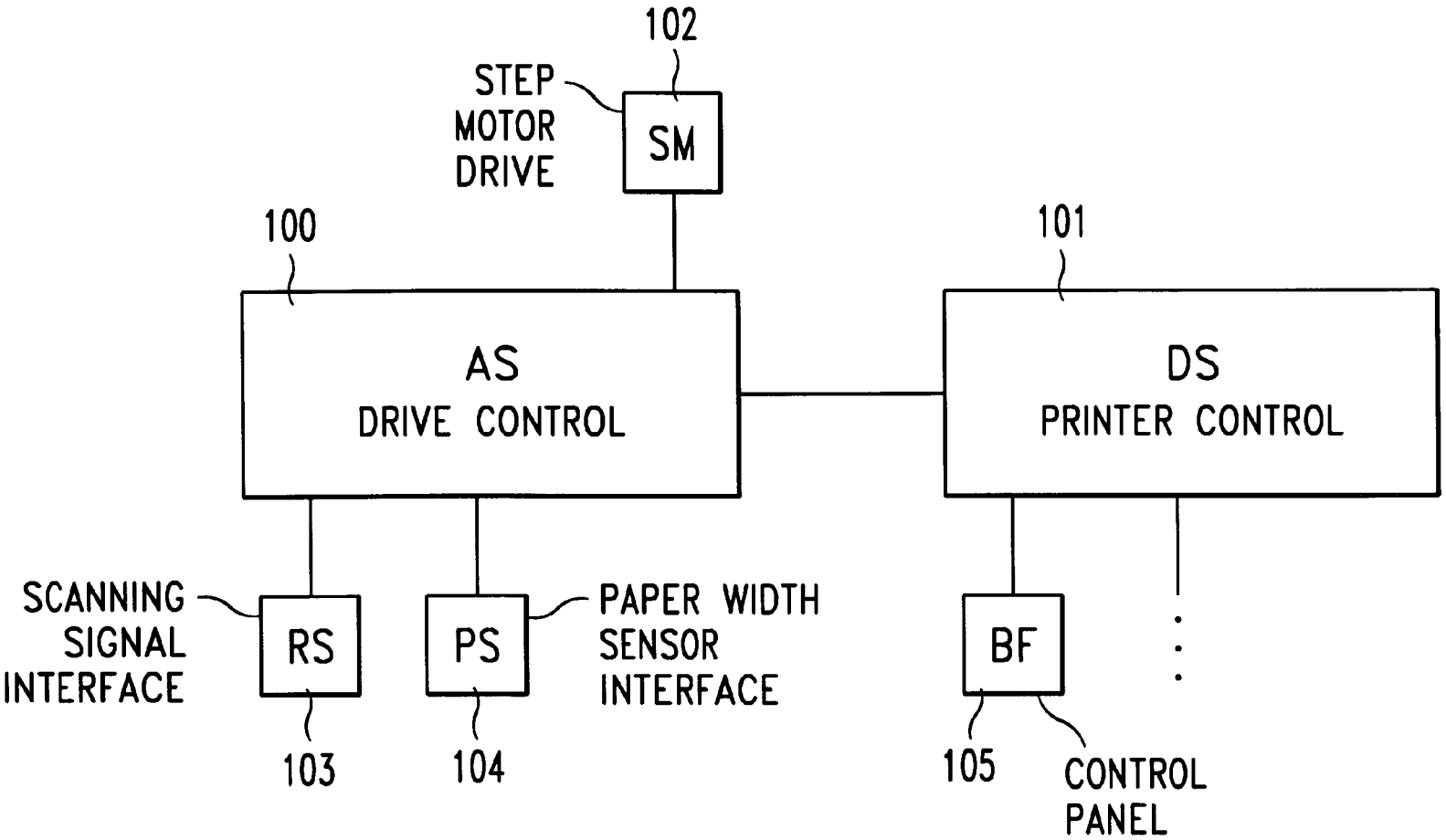
FIG. 7 shows a block circuit diagram for controlling the drive.

FIG. 7 shows several electronic components of the printer. The drive assembly 13 has a drive control 100, which is connected to the higher-ranking printer control 101. Operator instructions can be inputted via a control panel 105. The drive control 100 receives the signals of the paper width sensor 17, or respectively, 55, via its interface 104. From these, it computes both the width and the type of the paper; that is, whether or not there are margin perforations. The drive control 100 also receives the scanning signals of the pin feed wheel sensor 85 via the interface 103. From these, the speed of the recording medium 100 (the paper web 5) is computed in the drive control 100. The result is used to control the step motor drive 102. Position deviations and/or speed deviations of the paper web 5, such as are caused by slippage, longitudinal deviations (crumpling) of the paper, or mechanical imprecisions of the paper transport rolls, for instance, are thus compensated. The desired speed signals are delivered by the printer control 101.

To prepare a print process (start mode) following the startup of the printer or the insertion of a new paper web, the following procedure is followed:

A paper web with margin perforation is inserted into the printer manually through the various assembly components up to the drive assembly 13. There, the paper is threaded into the region of the rule 65 up to the guide surface 67, and the margin perforation engages the spindles of the pin feed wheel 82. In the area of the rule 65, the paper is fed via the drive motor 41. The operator determines the direction of the feed (forward/reverse) in order to align the beginning of a page precisely to a mark of the rule 65 that corresponds to the length of a page. The operator can adjust the feed. It occurs relatively slowly and in transport grid increments that correspond to fractions of the hole spacing. The hole spacing typically amounts to ½ inch (approx. 12.8 mm); the transport grid width, ⅙ inch. In this transport, the speed or position of the paper web 5 is already obtained using the pin feed wheel sensor 85 and is compared to the speed or position of the drive motor 41. Slippage that arises, i.e. a discrepancy between these two speeds or positions, is determined and is compensated by the drive control 100 by additional feed in a control grid with a width of 1/120 inch; that is, by additional steps of the step motor.

The relatively slow speed in the process thus described, which is executed by the operator, serves for aligning and positioning a specific feature, or respectively, a mark of the paper web 5 (e.g. a fold, a mark, a page break or the like) at a mark 65*a* that is stationary relative to the paper drive assembly 13, or respectively, at the above described rule 65. Given an incremental feed in the transport grid, the positioning of the paper web 5 is made significantly easier for the operator: a mispositioning would deviate from the desired position by at least the width of one transport grid and could therefore be detected easily visually.

During normal operation in which the print process is running, the paper web 5 is processed by the page, with complete pages always being printed. Slippage between drive 13 and paper web 5 is detected by the continuous scanning of the margin perforations 21. The slippage is compensated in this mode by controlling the speed of the drive motor.

The transport grid width is fitted to the page length of the marginperforated paper web 5. Given a transport grid width of ⅙ inch, page lengths of 3,3⅙,3⅓,3⅓,3⅙,3⅚,4,4⅙, . . . , 28 inches can be processed precisely by the page. Given nonperforated paper, the page length need not equal a multiple of the transport grid width, but can be quasi arbitrary. Nonperforated paper is therefore not transported in increments of the transport grid, but rather in arbitrarily small increments, up to continuous transport.

With the signals of the paper width sensor 17, the drive control 100 can also determine whether and what kind of paper has been inserted in the printer. For this purpose, the drive motor is driven back and forth, several times for example, and the sensor signals are evaluated. If one or more holes are detected, a perforated paper web is assumed. An automatic alignment to the hole grid can then be performed with the aid of the detected hole positions.

Figure 8:
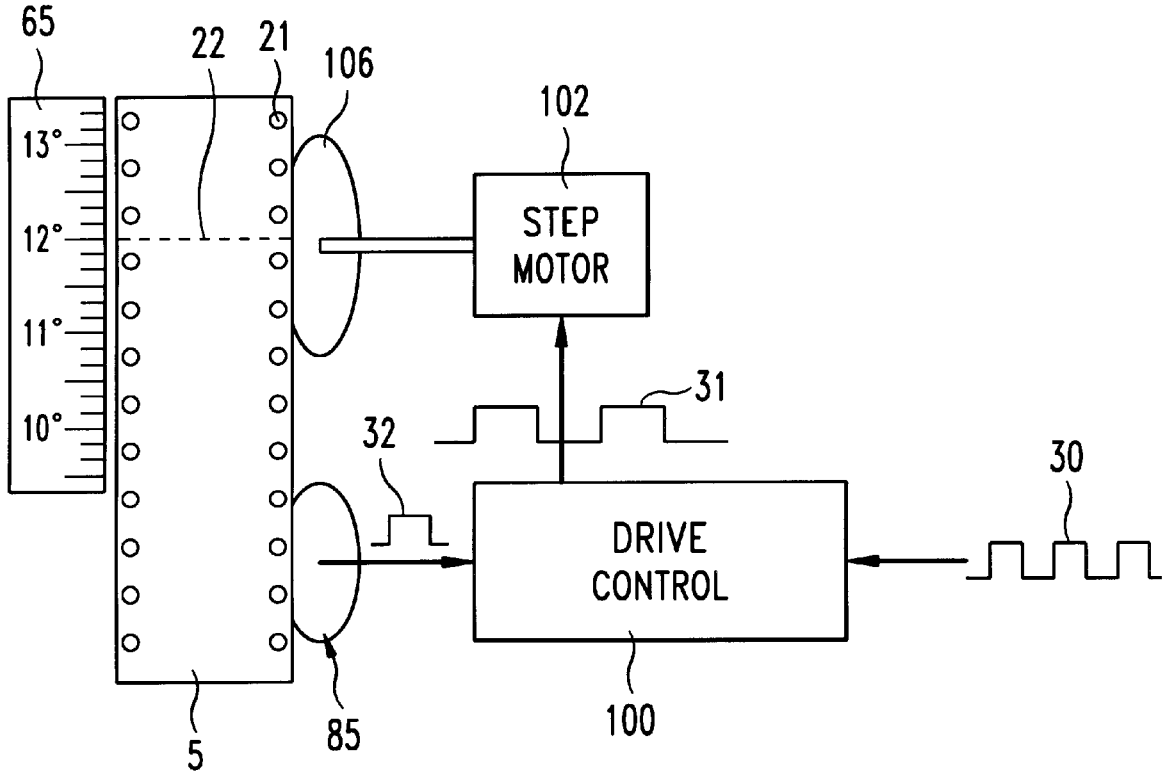
FIG. 8 shows an essential component of a drive.

FIG. 8 represents essential components of the friction drive again. The feed motion is transmitted onto the paper web 5 by frictional forces using a friction roller 106. The friction roller 106 is driven by a step motor 102, which is controlled on its part by the drive control 100 with control signals 31. The feed motion of the paper web 5 is controlled in that the current speed of the paper web is detected using the pin feed wheel sensor 85, and the sensor signals are fed to the drive control 100. The drive control 100 additionally receives the timing signals 30 from an image generating unit. From these input quantities, it computes the signals required for controlling the drive motor 102 in the ⅙ inch transport grid. On the other hand, it regulates the step motor 102 in small increments that correspond to a 1/120 inch regulating grid, so that the paper web 5 traverses exactly ⅙ inch relative to the rule 65 with each increment in the transport grid. Potential slippage between the friction roller and the paper web 5 is thus compensated. The recording on the paper web 5 is performed in the ⅙ inch grid with positional precision relative to the margin perforations 21, or respectively, the mark (fold or transverse perforation) 22 that marks the beginning of a page on the paper web.

In the drive control 100, the timing signals of the pin feed wheel sensor 85—i.e. the actual feed of the paper web 5—is compared in high resolution in a 1/120 inch grid to the desired feed positions that derive from the timing signals 30 of the image generating unit.

The drive control 100 compares the image generating signals 30, or respectively, selected signals from these, to the signals 32 of the pin feed wheel sensor 85 and forms drive signals 31 for the step motor 102, which respectively correspond to the feed of 1/120 inch on the paper web 5. For example, when the signals 30 of the exposure unit are delivered in a grid, which correspond to a 1/9600 inch feed on the recording medium 5, and the pin feed wheel sensor 85 generates a sensor signals 32 with every ½ inch of paper feed, then the drive control 100 respectively checks whether an impulse of the sensor signals 32 coincides with every $4800^{th}$ exposure impulse 30. If the sensor signals 32 occurs with a time difference relative to the exposure signal 30, the drive control detects slippage and forms more drive signals 31 per unit of time, accordingly. The drive signals 31 do not stand in a fixed frequency ratio to the exposure signals 30. On the basis of this frequency decoupling of the drive signals 31 from the exposure signals 30, the drive control 100 can detect occurring slippage in a 1/120 inch control grid with the aid of a time difference between the selected desired signals 31 and the actual signals 32 and can compensate this slippage flexibly and with high precision with reference to the ⅙ inch transport grid.

The exposure unit comprises a light emitting diode character generator (LED-ZG) as described in WO 96/27862 A. The timing signals 30 can be formed and/or tapped at a suitable location within the character generator described there. The contents of this WO publication are hereby incorporated into this specification by reference.

After the printer has been turned on, the overall drive is aligned to the ⅙ inch transport grid, or respectively, is fit into this grid. There, the control 100 generates drive cycles in steps of 1/120 inch, until the pin feed wheel sensor 85, or respectively, a margin perforation of the paper web 5, is located at a specific position (e.g. one spindle in a vertical position). When the drive has been aligned to the ⅙ inch transport grid, the paper web 5 can be advanced in this transport grid such that a reference point, for instance a fold 22, advance exactly one ⅙ inch increment marker on the rule 65 on the housing with each ⅙ inch transport increment. A mark of the paper web 5, for instance a transverse perforation or the fold, is then positioned at the corresponding page mark (10",11",12" or 13") of the rule 65 in ⅙ inch increments. The following pages are then automatically exactly positioned by the transport control.

Following the above described fitting of the paper web, the drive control 100 controls the drive in the ⅙ inch transport grid. The slippage compensation occurs in the control grid of 1/120 inches. For this purpose, the pin feed wheel sensor 85 comprises a resolution that is less than or equal to the transport grid width (⅙ inch), for instance ⅙, ⅓, or ½ inch. The closer the resolution of the pin feed wheel sensor 85 is to the hole spacing (½ inch) of the paper web 5, the more precise the information is which it delivers about where a transport hole 21 is located. For example, if the pin feed wheel sensor 85 resolves to ½ inch, then its signal declares that a transport hole 21 is located exactly in a region, which was known in advance, of the pin which is currently engaging. A defined relation of the hole position currently being scanned relative to the rule is thus automatically stated. The calibration dependency of different pin feed wheel sensors can be balanced by a one-time reference measurement with a determination of an offset value. The recognition of the unambiguous assignability of the hole position is particularly advantageous in a highspeed start mode: during the fitting of the paper web into the transport grid, care can be automatically taken that the margin holes 21 are located at defined positions of the rule 65. The above described step, which is to be executed by the operator, of positioning a specific mark of the paper web 5 at a mark 65*a* of the rule 65 can be omitted in appropriate cases, for instance when the page length is not important. The correct position of the beginning of the page relative to the margin perforations 21, which may be required for postprocessing the printed paper web 5 in cutting devices, for example, is then present despite the simplified start operation.

It is clear that other transport and control grids can be used instead of the described ⅙ inch transport grid and the 1/120 inch control grid. The control grid is finer than the transport grid. The grids were defined in a reference system which is based on inches, though it can of course also be transformed into other reference systems, for instance to increments of the step motor or to rotational angles of corresponding drive or sensor axles. In the drive control 100, the actual feed signals delivered by the pin feed wheel sensor 85 are compared to the exposure signals 30 delivered by the image generating unit, in order to be able to compute correction quantities for controlling the step motor 102.

The pin feed wheel sensor is only needed when margin-perforated paper is used. For this purpose, it is mounted such that it can be pivoted in and out within the drive assembly. Instead of the described pin feed wheel sensor, other sensors can be used to scan the margin perforations, for instance light barriers which detect margin perforations using reflected light or transmitted light, or CCD line sensors. Such sensors can be fixed to the device. They need not be pivoted out when paper without margin perforations is processed.

Though the invention was described predominantly with exemplifying embodiments that use paper as the recording medium, it can of course also be applied in connection with other recording mediums such as foils. It is not bound to any particular imaging means such as photoconductive drums, either, but can be used in connection with band-shaped transmission media such as photoconductive tape or magnetographic devices.

Although various minor changes and modifications might be proposed by those skilled in the art, it will be understood that my wish is to include within the claims of the patent warranted hereon all such changes and modifications as reasonably come within my contribution of the art.

What is claimed is:

1. A method for controlling a tractorless drive in an electrographic printer which prints by page on a band-shaped recording medium, comprising the steps of:

first transporting a margin-perforated recording medium in a start mode in increments of a control grid and fitting the control grid into a second grid forming a transport grid which is larger than the control grid, and which corresponds to a fraction of hole spacing;

in a drive control receiving target signals as image generating signals of a first frequency which are generated by an image generating unit or are synchronous to signals of the image generating unit, actual signals of a second frequency being received by a sensor arrangement that continually scans the recording medium, and forming control signals of a third frequency for driving a drive motor from a comparison of the target signals and the actual signals;

providing the drive in increments of the control grid, and regulating a speed of the drive motor; and the control signals for the drive motor not standing in a fixed frequency ratio to the image generating signals.

2. The method as claimed in claim 1 in which the drive motor is a step motor.

3. The method according to claim 1 wherein the actual signals are delivered by a sensor arrangement that detects at least one of position and speed of the recording medium continuously.

4. The method as claimed in claim 1 in which an anti-slippage control is provided which compensates slippage between a friction roll and the recording medium web by at least one of additional feeding and by raising the drive speed.

5. The method as claimed in claim 1 in which the recording medium has margin holes.

6. The method as claimed in claim 5 in which the sensor signals correspond precisely to spacing of the margin holes given a margin-perforated recording medium.

7. The method as claimed in claim 1 in which the drive signals correspond to a feed of the recording medium in the control grid, and the image generating signals correspond to a fraction thereof.

8. The method as claimed in claim 1 in which during a normal operation, control signals for driving a step motor are formed, which correspond to the transport grid.

9. The method as claimed in claim 1 in which it is determined whether the recording medium has margin perforations before the drive is set in motion.

10. The method as claimed in claim 1 wherein a recording medium which is provided with margin perforations is aligned in increments of the transport grid, to a rule that is stationary relative to the drive, in such a way that a mark of the recording medium is aligned to a mark of the rule that corresponds to provided page length.

11. The method as claimed in claim 1 wherein when a print stoppage is required, the recording medium web is stopped in such a way that a predetermined position in a page boundary attains a predetermined position of the transport path of the recording medium carrier.

12. A control for a tractorless drive in an electrographic printer which prints on a web-shaped recording medium page by page, comprising:

a control unit which controls a motor in a start mode such that the recording medium in the start mode is first transported in increments of a control grid, and is thus fitted into a second grid comprising a transport grid, which is larger than the control grid and which corresponds to a fraction of the hole spacing;

the control unit being constructed so as to be able to receive target signals as image generating signals of a first frequency which are generated by an image generating unit or are synchronous to signals of the image generating unit, and are able to receive actual signals of a second frequency from a sensor arrangement that continuously scans the recording medium, and is able to form control signals of a third frequency for driving a drive motor from a comparison of the target signals and the actual signals;

the control unit controlling the driving in increments of a control grid; and the control unit control signals for the drive motor not standing in a fixed frequency ratio to the image generating signals.

13. The control as claimed in claim 12 in which a first sensor is provided which detects at least one of position and speed of the web-shaped recording medium.

14. The control as claimed in claim 12 wherein the first sensor is conductively connected to the control unit, and the control unit is implemented as a control for the drive.

15. The control as claimed in claim 13 in which the first sensor is constructed so as to be able to monitor transport holes of a margin-perforated recording medium, and such that the sensor comprises a pin feed wheel.

16. The control as claimed in claim 12 in which a second sensor is provided with which it is possible to detect whether a perforated or a nonperforated recording medium has been inserted into the printer.

17. An electrographic printer, comprising:

a drive and a control unit;

said control unit controlling the motor in a start mode such that a recording medium in the start mode is first transported in increments of a control grid, and is thus fitted into a second grid comprising a transport grid which is larger than the control grid and which corresponds to a fraction of the hole spacing;

the control unit being constructed so as to be able to receiver target signals as image generating signals of a first frequency which are generated by an image generating unit or are synchronous to signals of the image generating unit, to be able to receive actual signals of a second frequency from a sensor arrangement that continuously scans the recording medium, and to be able to form control signals of a third frequency for driving a drive motor from a comparison of the target signals and the actual signals;

the control unit controlling the driving in increments of a control grid; and the control unit control signals for the drive motor not standing in a fixed frequency ratio to the image generating signals.

18. The electrographic printer as claimed in claim 17 in which the drive comprises a step motor and a friction roll which is driven by said motor.

* * * * *